US006109286A

United States Patent [19]

Johnston

[11] Patent Number: 6,109,286

[45] Date of Patent: Aug. 29, 2000

[54] ADDITIVE INJECTION SYSTEM

[75] Inventor: James M. Johnston, Houston, Tex.

[73] Assignee: Precision Blending Systems, Inc., Houston, Tex.

[21] Appl. No.: 09/234,802

[22] Filed: Jan. 19, 1999

[51] Int. Cl.[7] ..... E03B 11/00

[52] U.S. Cl. ..... 137/15.05; 137/565.33; 137/599.03; 137/599.12

[58] Field of Search ..... 137/15.05, 565.33, 137/599.03, 599.04, 599.12

[56] References Cited

U.S. PATENT DOCUMENTS 3,179,291 4/1965 Umbach et al. ..... 137/565.33 X 4,918,659 4/1990 Bragg et al. ..... 137/15.05 X 4,941,596 7/1990 Marty et al. ..... 137/565.33 X

*Primary Examiner*—John Rivell

*Attorney, Agent, or Firm*—The Matthews Firm

[57] ABSTRACT

A system for flushing an injection system used on multiple loading arms. Use of a flush pump localized to each injection manifold at each loading arm results in a more cost effective manner of constructing an injection system with flushing capabilities. The injection system is capable of being expanded or contracted with additional or fewer injection manifolds and loading arms as demand dictates.

12 Claims, 4 Drawing Sheets

ADDITIVE INJECTION SYSTEM

BACKGROUND

Injection systems are used in the petrochemical industry for a number of purposes. It is frequently desirable to have an injection system capable of injecting at least one additive into a product line. The prior art teaches a manifold injection system. Typically, when one wishes to change the additive that is being mixed into the product, one flushes the injection manifold.

Frequently, such injection systems are used in fuel storage and loading terminals. Fuel storage and loading terminals typically store one or more products and have multiple loading arms through which to load portable containers with those products. Manifold injection systems are used on or near the loading arm to inject gasoline or diesel additives and dyes into the products as they are pumped into the containers.

The prior art teaches the use of an additive injection system having an injection manifold connected at one end to a valve and a large flush pump and at the other end to the product line. The large flush pump draws from earlier in the product line or from a similar product line and services all of the injection manifolds at a location. When flush is desired of any particular injection manifold, the valve for that injection manifold is opened, allowing the flush pump to pump product through the injection manifold. The drawbacks to the prior art include lack of flexibility and the great expense associated with the large flush pump and the plumbing from that large flush pump to multiple injection manifolds. The prior system also does not insure flushing with a product identical to the product serviced by the injection manifold.

It would be a benefit to provide a more flexible system for flushing an injection system, particularly one capable of being expanded (e.g. having injection manifolds added) or contracted (e.g. removing injection manifolds) as demand dictates. It would also be a benefit to provide a more cost effective manner of constructing an injection system with flushing capabilities. It would be a further benefit to provide a flushing system that flushed the injection manifold with the exact product serviced by that injection manifold.

DESCRIPTION OF THE PREFERRED EMBODIMENT

Figure 1:
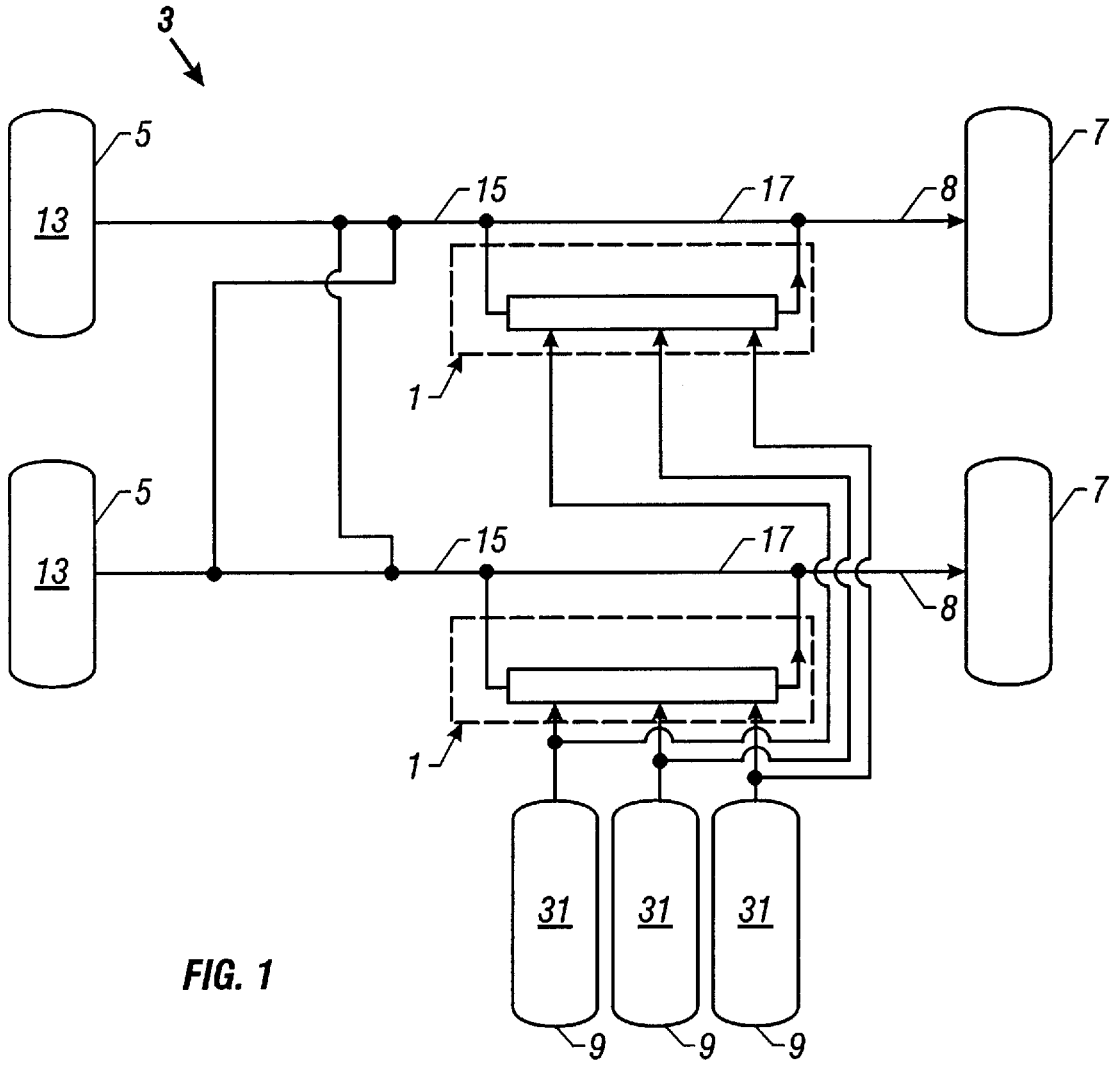
FIG. 1 is a schematic of a fuel storage and loading terminal having the capability to accept two products and three additives and provide output to two containers.

Referring to FIG. 1, an injection system 1 is installed at a fuel storage and loading terminal 3 to assist in gasoline or diesel distribution. As to the fuel storage and loading terminal 3 generally, a product fluid 13 from a product line 5 flows through an entry pipe 15 into a feed pipe 17, exiting the fuel storage and loading terminal 3 through a loading arm 8 into a container 7. The container 7 can be any portable container capable of transporting fluid to a remote location, such as, without limitation, a truck, train car, barge, or boat.

The injection system 1 is connected in parallel to the feed pipe 17. The injection system 1 is also connected to at least one additive tank 9. The injection system 1 injects additives 31 from the additive tanks 9 into the feed pipe 17. The additives 31 may consist of gasoline detergent additive, diesel dye, diesel additive, or any other substance desired to be mixed into a base product 5. The resulting mixed fluid is pumped into the containers 7 via loading arms 8. When injection is finished, some of the product fluid 13 in the feed pipe 17 is pumped through the injection system 1 in order to flush the injection system 1.

Figure 2:
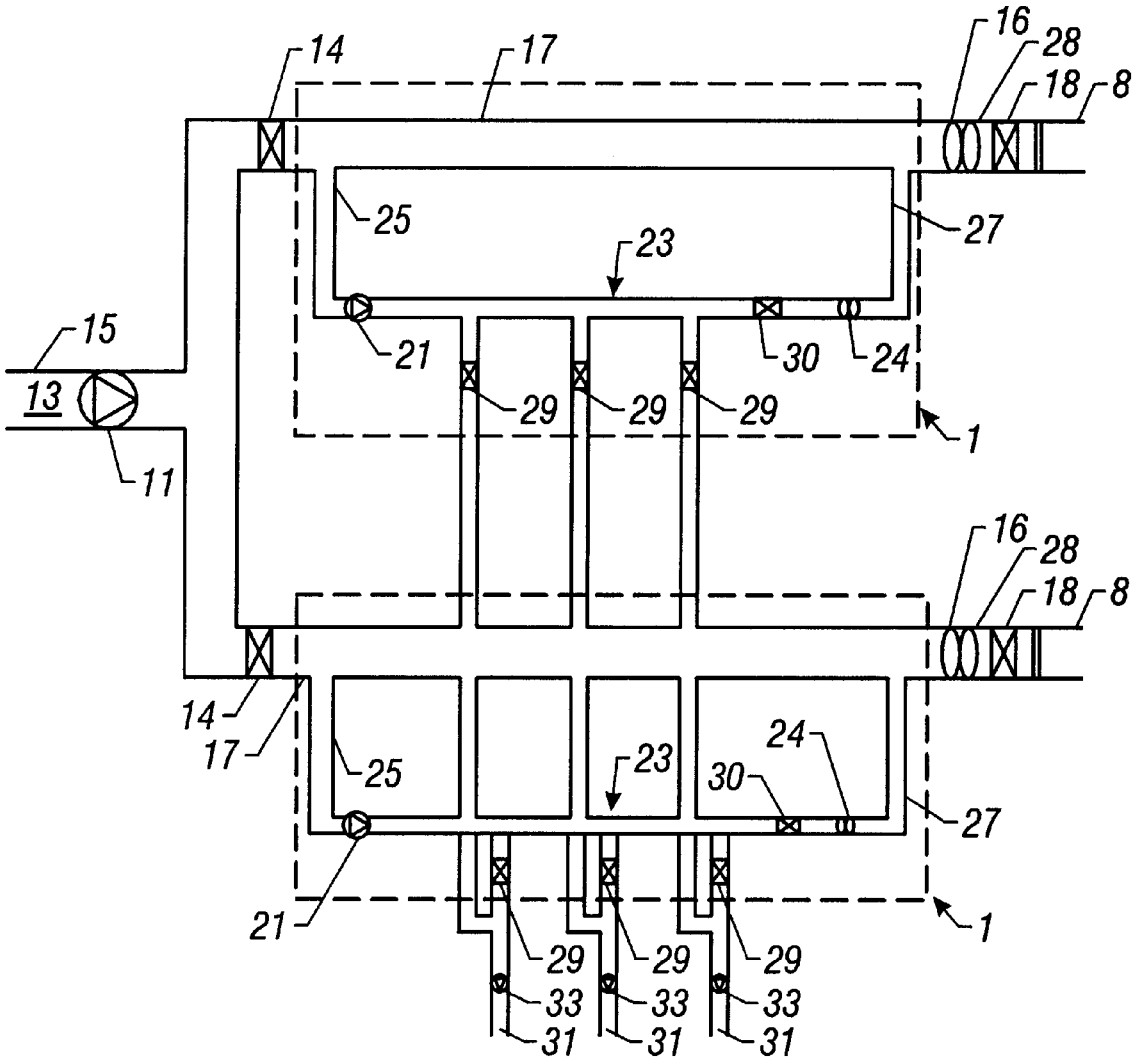
FIG. 2 is a plan view of two loading arms of a fuel storage and loading terminal equipped with injection systems.

FIG. 2 shows two injection systems 1 as they would attach to feed pipes 17 to service two loading arms 8. One such injection system 1 is used for each loading arm 8 to be serviced. Product fluid 13 is delivered to a product fluid pump 11 by an entry pipe 15 from the product lines 5 (FIG. 1). The product fluid pump 11 pumps the product fluid 13 into at least two feed pipes 17. Each feed pipe 17 is equipped with a feed pipe valve 14, a product flow meter 16, and a product valve 18. Each injection system 1 attaches to the feed pipe 17 in parallel. Each injection system 1 is comprised of an input pipe 25, a local flush pump 21, an injection manifold 23, an injection manifold meter 24 and a return pipe 27. Generally the input pipe 25 and the return pipe 27 are of narrower diameter than the feed pipe 17. The return pipe 27 attaches to the feed pipe 17, which is in turn attached to the output pipe 28. The output pipe 28 is in turn connected to the loading arm 8. Attached to the injection manifold 23 is at least one additive selection valve 29. The additive selection valve 29 is controllable and can be activated pneumatically, electrically, hydraulically, or in any other way well known in the actuated valve art. The number of additive selection valves 29 is equal to the number of additives to be added to the product fluid 13. For example, FIG. 2 demonstrates a system capable of injecting three additives.

The additives 31 are pumped from the additive tanks 9 (FIG. 1) by additive pumps 33. The additive selection valves 29 may be capable of a variable range of flows in order to regulate the flow of the additives 31 into the product 13. In an alternative embodiment, the additive selection valves 29 may be solenoid valves, capable of only opening or closing. If the additive selection valve 29 is of a solenoid type, a regulated additive injection valve 30 may be added to the injection system 1 in order to regulate flow of the additives 31 into the product 13.

Figure 3:
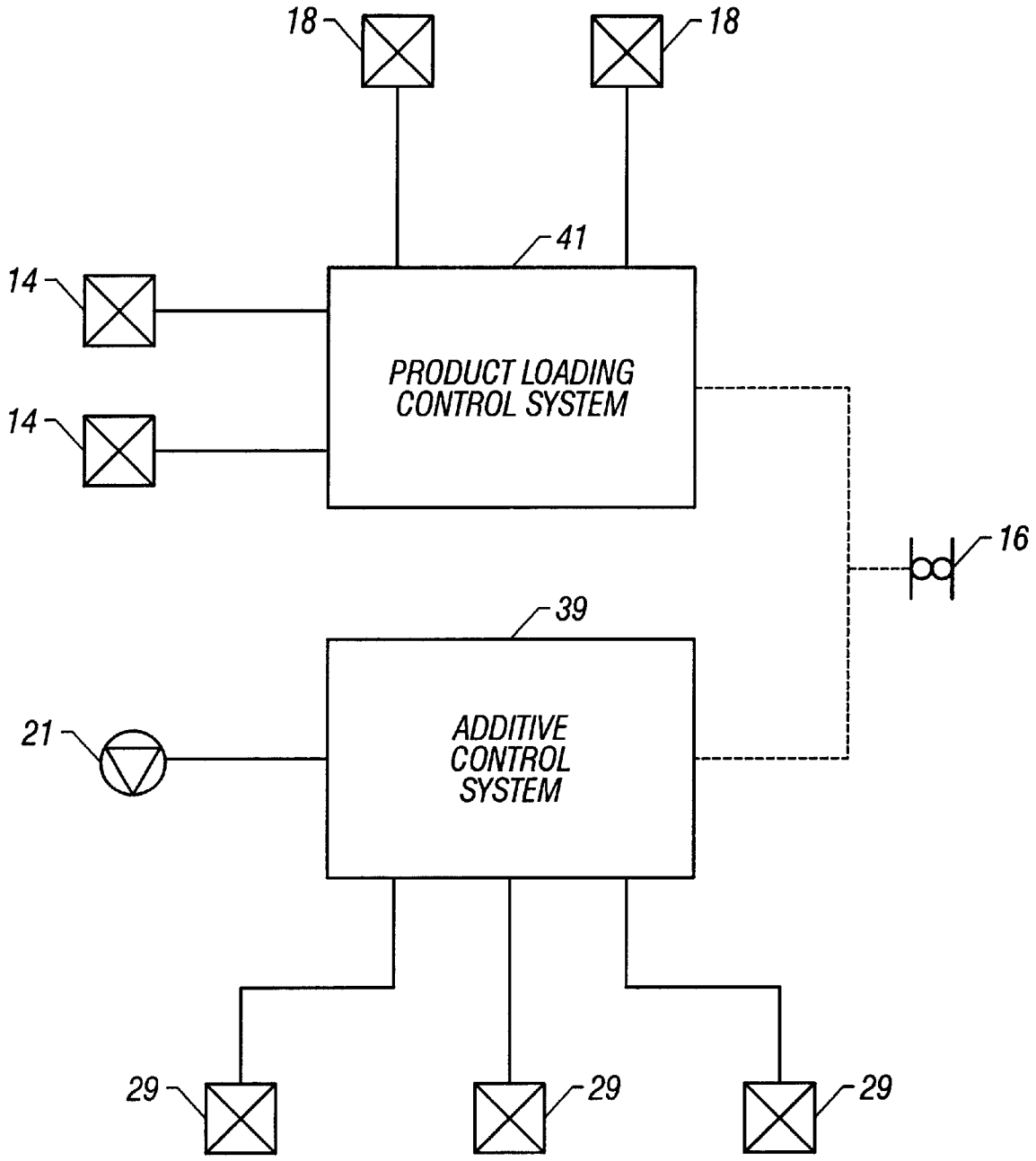
FIG. 3 is a schematic view of the additive control system of the present invention, its inputs, and its outputs.

The electrical and control system is described by FIG. 3. An additive control system 39 is electrically connected to each flush pump 21, each injection manifold meter 24, and each additive selection valve 29. The additive control system 39 is directly connected to the product meter 16.

In an alternative embodiment, the additive control system 39 may be electrically connected to a product loading control system 41. The product loading control system 41 is electrically connected to the feed pipe valve 14, the product meter 16, and the product valve 18 in order to control and monitor the flow of product liquid 13 (FIG. 2) into the container 7 (FIG. 2). The product loading control system 41 can be any of those systems well known in the art for controlling the flow of product fluid 13 (FIG. 2) through the feed pipe 17 (FIG. 2) and the loading arm 8 (FIG. 2) into the container 7 (FIG. 2). It is noted that the additive control system 39, in another embodiment, may be incorporated into the product loading control system 41 or other existing control or automation systems, or vice versa, without affecting the function described.

The operation of the injection system 1 is described with reference to FIG. 2. Each injection system 1 accepts additive 31 from the additive tank 9 and pumps the additive 31 into the injection manifold 23, through the injection manifold meter 24, and through the return pipe 27 into the feed pipe 17, where it mixes with the product fluid 13 and exits through the output pipe 28. The mixture of the product fluid 13 and the additive 31 pass through the loading arm 8 into the container 7.

Figure 4:
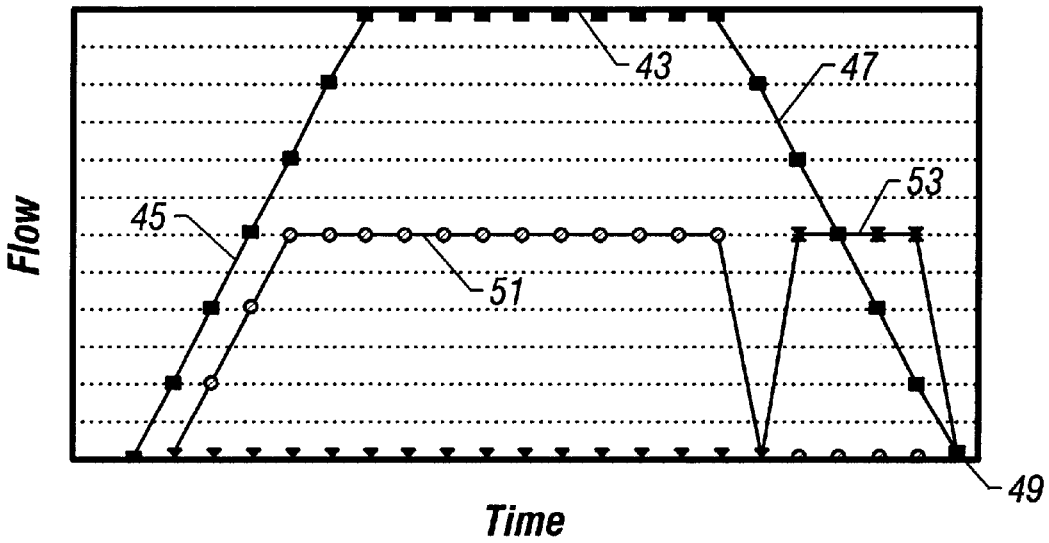
FIG. 4 is a graph demonstrating the operation of the injection system during a loading cycle.

The additive control system 39 operation during a load cycle of the container 7 is demonstrated by FIG. 4. Flow into the container 7 is shown on the vertical axis; time is shown on the horizontal. It is known in the art for the product loading control system 41 to provide a flow of product fluid 13 into a container 7 via a feed pipe 17 as depicted by line 43. Accordingly, at the beginning of the load cycle, the flow undergoes a "ramp up" 45 until the desired flow is achieved. At the end of the load cycle, the flow undergoes a "ramp down" 47 until the desired volume in the container 7 is achieved, at which time flow stops 49.

When the product loading control system 41 begins to "ramp up" 45, the additive control system 39 detects the flow either by receiving an electrical signal from the product loading control system 41 or directly from the product meter 16. After a short delay, the additive control system 39 activates the additive selection valve 29. If the additive selection valve 29 is of a variable control type it can provide an even flow as depicted by line 51. If the additive selection valve 29 is not variable (e.g. digital), then a flow of additive 31 may be provided periodically, the additive selection valve 29 being opened and closed many times in order to provide the correct amount of additive 31. In the alternative, if the additive selection valve 29 is digital and the system is equipped with the regulated additive injection valve 30, the additive selection valve 29 may be activated and the flow controlled by the regulated additive injection valve 30.

When the product loading control system 41 begins to "ramp down" 47, that ramp down is detected by the additive control system 39, either by signal from the loading control system 41 or by detecting reduced flow at the product meter 16. The additive control system 39 then deactivates the additive selection valve 29, as depicted by line 51, and activates the flush pump 21, as depicted by line 53, until no more pulses are detected from the product meter 16, indicating that loading has ceased.

The activation of the flush pump 21 serves to pump product fluid 13 out of the feed pipe 17 and through the injection manifold 23, thereby flushing out the injection manifold 23 and the output pipe 27, so that no additive 31 remains therein. The provision of a flushing mechanism is known in the art to have several advantages. First, a flushing mechanism can prevent leakage and seeping from the injection system 1 of an undesired additive 31. Second, a flushing mechanism can prevent cross mixing of additives 31 into one another. Third, flushing enhances the operation of the additive selection valve 29 by minimizing exposure to the additives 31 which are often very viscous and can interfere with the operation of the additive selection valve 29.

The invention of providing one flush pump 21 for each injection manifold 23 has several key additional advantages. First, the flush pump 21 may be relatively small and inexpensive, as it need only flush a single injection manifold 23. Second, the flush pump 21 may be easily replaced or serviced without shutting down the entire loading operation. Third, the ability to use a smaller, localized flush pump 21 that can be easily removed without substantial plumbing changes if no longer needed makes for a more cost effective system upgrade or downgrade, should loading arms 8 need to be added or removed from the fuel storage and loading terminal 3. Fourth, the injection system 1 can be flushed with the same product into which the additive 31 is injected, since the flush pump 21 is supplied within the injection system 1 instead of closer to the product line 5.

Although the preferred embodiment is described in terms of a fuel storage and loading terminal, it will be appreciated that this invention has wider applicability to any product line, hydrocarbon, chemical, or otherwise, to which one or more additives may be added at several loading locations.

As to the manner of operation and use of the present invention, the same is made apparent from the foregoing discussion. With respect to the above description, it is to be realized that although dimensional embodiments of specific material is disclosed, those enabling embodiments are illustrative, and the optimum dimension relationships for the parts of the invention are to include variations in composition, form, function and manner of operation, assembly and use, which are deemed readily apparent to one skilled in the art in view of this disclosure, and all equivalent relationships to those illustrated in the drawings and encompassed in the specifications are intended to be encompassed by the present invention.

Therefore, the foregoing is considered as illustrative of the principles of the invention and since numerous modifications will readily occur to those skilled in the art, it is not desired to limit the invention to the exact construction and operation shown or described, and all suitable modifications and equivalents may be resorted to, falling within the scope of the invention.

What is claimed is:

1. A system for injecting an additive into a product fluid comprising:

an additive input line;

a product fluid input line;

a first feed pipe;

a second feed pipe;

a first output line;

a second output line;

a first injection manifold;

a second injection manifold;

a first flush pump;

and a second flush pump;

wherein the product fluid input line is connected to the first feed pipe and the second feed pipe; the first feed pipe is connected to the first output line; the second feed pipe is connected to the second output line; the first injection manifold is connected at both ends to the first feed pipe; the second injection manifold is connected at both ends to the second feed pipe; the first flush pump is situated within the first injection manifold; the second flush pump is situated within the second injection manifold; and the additive input line is connected to the first injection manifold and the second injection manifold.

2. The system of claim 1 further comprising:

a first additive selection valve; and a second additive selection valve;

the first additive selection valve disposed between the first injection manifold and the additive input line; and the second additive selection valve disposed between the second injection manifold and the additive input line.

3. The apparatus of claim 2 further comprising:

an injection control system; the injection control system connectable to the first additive selection valve, the second additive selection valve, the first flush pump, and the second flush.

4. The apparatus of claim 3 further comprising:

a first product meter and a second product meter; the first product meter disposed within the first feed pipe and the second product meter disposed within the second feed pipe.

5. The apparatus of claim 3 further comprising:

a first product meter; and a second product meter; the first product meter disposed within the first output line; and the second product meter disposed within the second output line.

6. The apparatus of claim 4 wherein the first product meter product meter and the second product meter are connected to the injection control system.

7. The apparatus of claim 5 wherein the first product meter product meter and the second product meter are connected to the injection control system.

8. The apparatus of claim 3 further comprising:

a loading control system; the loading control system connectable to the injection control system.

9. The apparatus of claim 4 wherein the product fluid comprises a petroleum product.

10. A method for injecting an additive into a product fluid comprising the steps of:

providing an injection system equipped with a first feed pipe and a second feed pipe;

accepting the additive into the injection system;

accepting the product fluid into the injection system;

equipping the first feed pipe with a first injection manifold;

equipping the second feed pipe with a second injection manifold;

equipping the first injection manifold with a first flush pump;

equipping the second injection manifold with a second flush pump;

injecting the additive into the first injection manifold;

flushing the first injection manifold with the first flush pump;

providing a first output from the injection system; and providing a second output from the injection system.

11. The method of claim 10 wherein an injection control system is programmed to activate injection into the first injection manifold after flow begins out of the first output;

the injection control system is programmed to deactivate injection into the first injection manifold after a decrease in flow out of the at least one output;

the injection control system is programmed to activate the flush pump after deactivation of the injection into the first injection manifold; and the injection control system is programmed to deactivate the flush pump as flow ceases from the first output.

12. The method of flushing out more than one additive injection manifold within a petrochemical loading terminal having more than one loading arm comprising the steps of:

providing one flush pump per additive injection manifold, and activating each flush pump at the end of a loading cycle.

* * * * *